US009629474B2

(12) United States Patent
Wilson

(10) Patent No.: US 9,629,474 B2
(45) Date of Patent: Apr. 25, 2017

(54) CHILDREN'S TABLE ASSEMBLY

(71) Applicant: Eugene Wilson, Waukesha, WI (US)

(72) Inventor: Eugene Wilson, Waukesha, WI (US)

( * ) Notice: Subject to any disclaimer, the term of this patent is extended or adjusted under 35 U.S.C. 154(b) by 147 days.

(21) Appl. No.: 14/749,837

(22) Filed: Jun. 25, 2015

(65) Prior Publication Data

US 2016/0374480 A1 Dec. 29, 2016

(51) Int. Cl.

| | |
|---|---|
| ***A47D 3/00*** | (2006.01) |
| ***A47B 13/08*** | (2006.01) |
| ***A47B 27/02*** | (2006.01) |
| ***A47C 7/50*** | (2006.01) |

(52) U.S. Cl.

CPC ..... *A47D 3/005* (2013.01); *A47B 13/083* (2013.01); *A47B 27/02* (2013.01); *A47C 7/50* (2013.01)

(58) Field of Classification Search

USPC ..... 297/136, 137, 142

See application file for complete search history.

(56) References Cited

U.S. PATENT DOCUMENTS 1,048,080 A * 12/1912 Kohl ..... B62K 9/02 280/87.03
1,265,999 A * 5/1918 Cusanelli ..... A47C 9/022 248/240
1,313,330 A * 8/1919 Pocock ..... A47D 1/002 280/87.051
1,326,921 A * 1/1920 Dzimitowicz ..... A47D 13/043 297/136
1,550,553 A * 8/1925 Macklem ..... A47D 1/02 297/136
2,198,813 A * 4/1940 Hall ..... A47D 13/043 280/7.1
2,339,647 A * 1/1944 Meyer ..... A47B 77/10 101/DIG. 36
D137,954 S 5/1944 Puls et al.
D143,494 S * 1/1946 Lamm ..... 297/137
D146,796 S 5/1947 Johnson
2,454,599 A * 11/1948 Dunson ..... A47D 3/005 297/137
2,461,715 A 2/1949 Biggerstaff
2,481,725 A 9/1949 Culley et al.
2,483,062 A * 9/1949 Puls ..... A47B 83/02 108/50.11
2,503,199 A 4/1950 Goldblatt et al.
2,551,999 A 5/1951 Ditty, Sr.
2,683,482 A * 7/1954 Puls ..... A47D 3/005 108/27
2,695,656 A 11/1954 Wagman
2,728,377 A * 12/1955 Thompson ..... A47D 1/004 297/137
3,330,609 A * 7/1967 Tippett ..... A47B 77/10 297/142
3,454,272 A * 7/1969 Rekow ..... A63H 33/32 297/137

(Continued)

*Primary Examiner* — David E Allred

(57) ABSTRACT

A children's table assembly includes a table that has a platform and a frame. A chair is rotatably coupled to the table and the chair is positioned on the frame. Thus, chair facilitates a user to access an entirety of the platform. A pair of containers is provided and each of the containers is rotatably coupled to the table such that each of the containers is positionable between a deployed position and a stored position. An easel is attached to the table.

10 Claims, 5 Drawing Sheets

(56) References Cited

U.S. PATENT DOCUMENTS

| | | | | | |
|---|---|---|---|---|---|
| 3,737,195 | A * | 6/1973 | Black | A47C 9/022 | 248/417 |
| 4,743,008 | A * | 5/1988 | Fermaglich | A47D 13/043 | 297/137 |
| 5,302,163 | A * | 4/1994 | Fermaglich | A47D 13/043 | 297/137 |
| 5,352,014 | A * | 10/1994 | Allen | A47B 83/02 | 297/142 |
| 5,683,065 | A * | 11/1997 | Allen | A47C 9/022 | 248/163.1 |
| 5,711,572 | A * | 1/1998 | Khan | A47B 3/14 | 297/140 |
| 6,000,750 | A | 12/1999 | Rossman et al. | | |
| 8,245,649 | B1 | 8/2012 | Ratliff et al. | | |
| 8,303,033 | B2 | 11/2012 | Lundeen | | |
| 2016/0003571 | A1 * | 1/2016 | Kleinfelder | F41A 23/16 | 42/94 |

* cited by examiner

CHILDREN'S TABLE ASSEMBLY

BACKGROUND OF THE DISCLOSURE

Field of the Disclosure

The disclosure relates to table devices and more particularly pertains to a new table device to be used by a child to play with toys.

SUMMARY OF THE DISCLOSURE

An embodiment of the disclosure meets the needs presented above by generally comprising a table that has a platform and a frame. A chair is rotatably coupled to the table and the chair is positioned on the frame. Thus, chair facilitates a user to access an entirety of the platform. A pair of containers is provided and each of the containers is rotatably coupled to the table such that each of the containers is positionable between a deployed position and a stored position. An easel is attached to the table.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
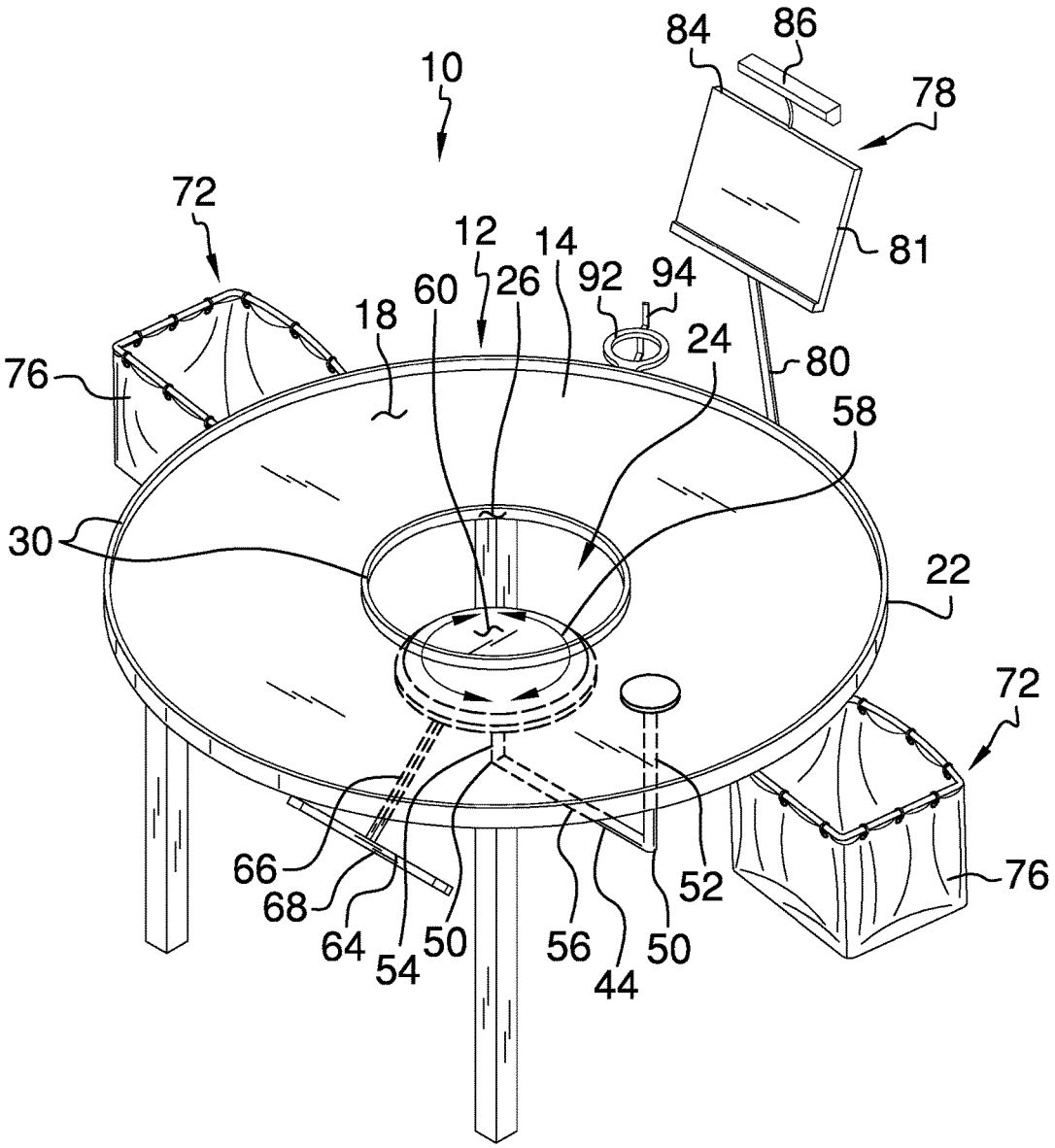
FIG. 1 is a top perspective view of a children's table assembly according to an embodiment of the disclosure.
Figure 2:
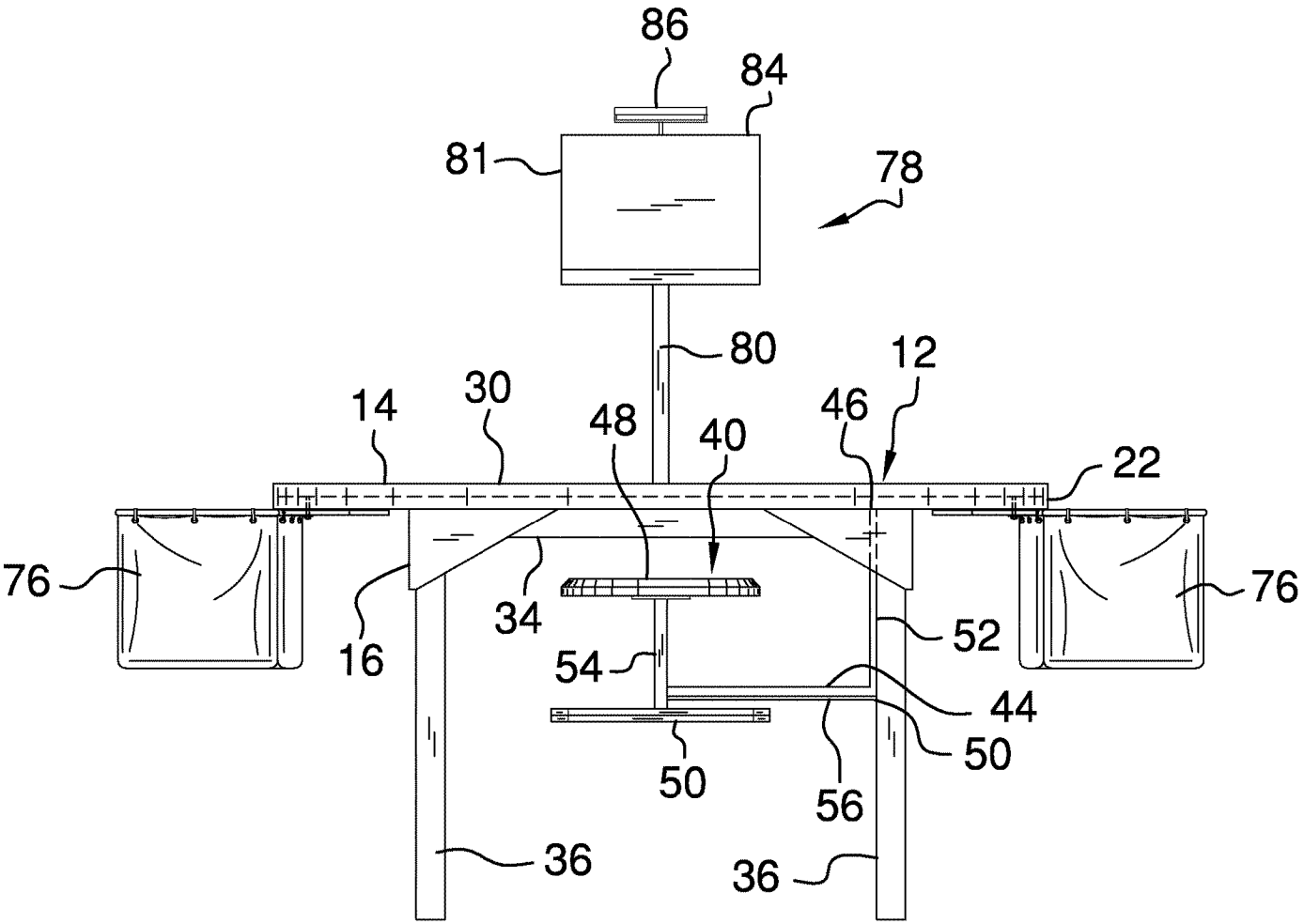
FIG. 2 is a front view of an embodiment of the disclosure.
Figure 3:
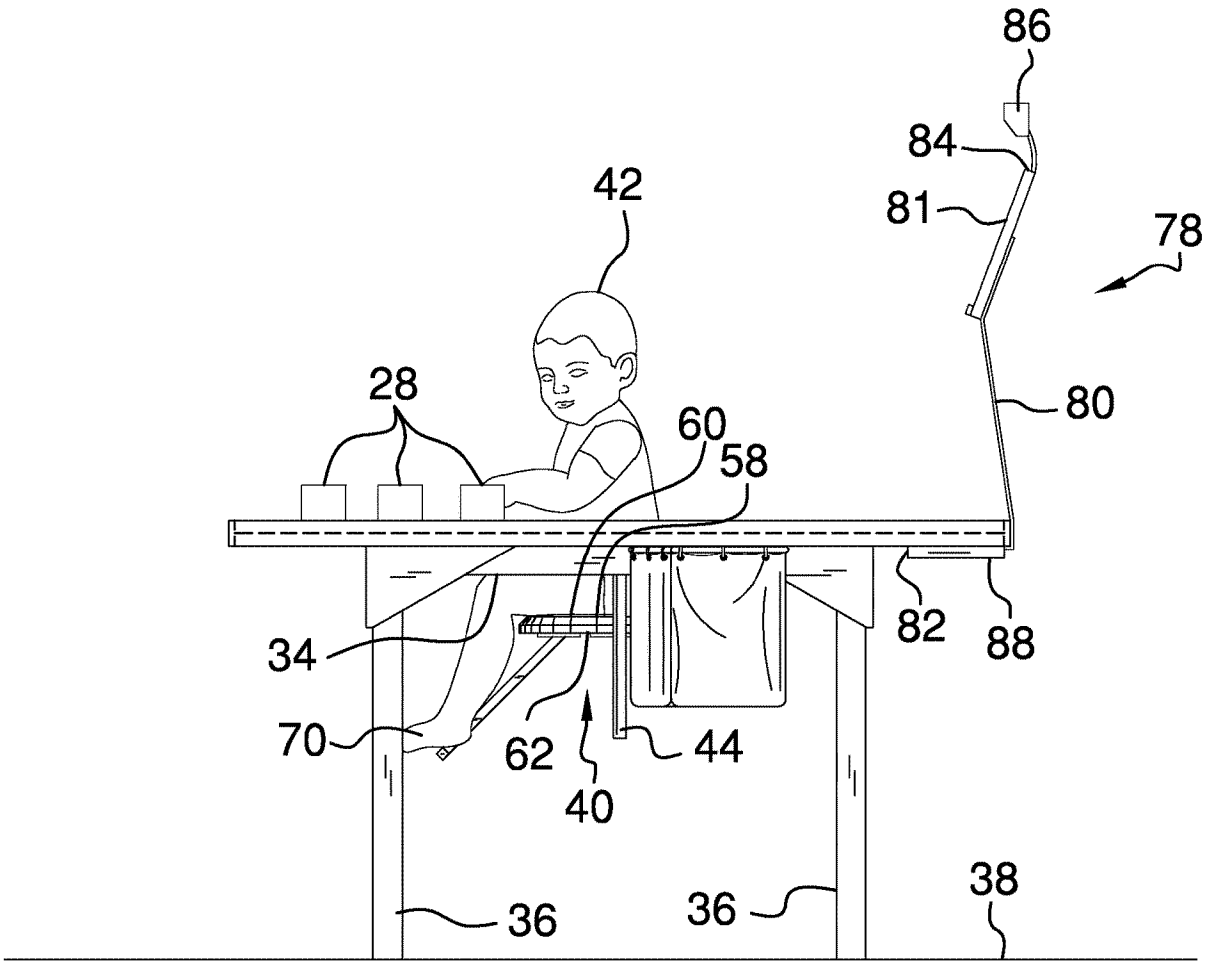
FIG. 3 is a left side in-use view of an embodiment of the disclosure.
Figure 4:
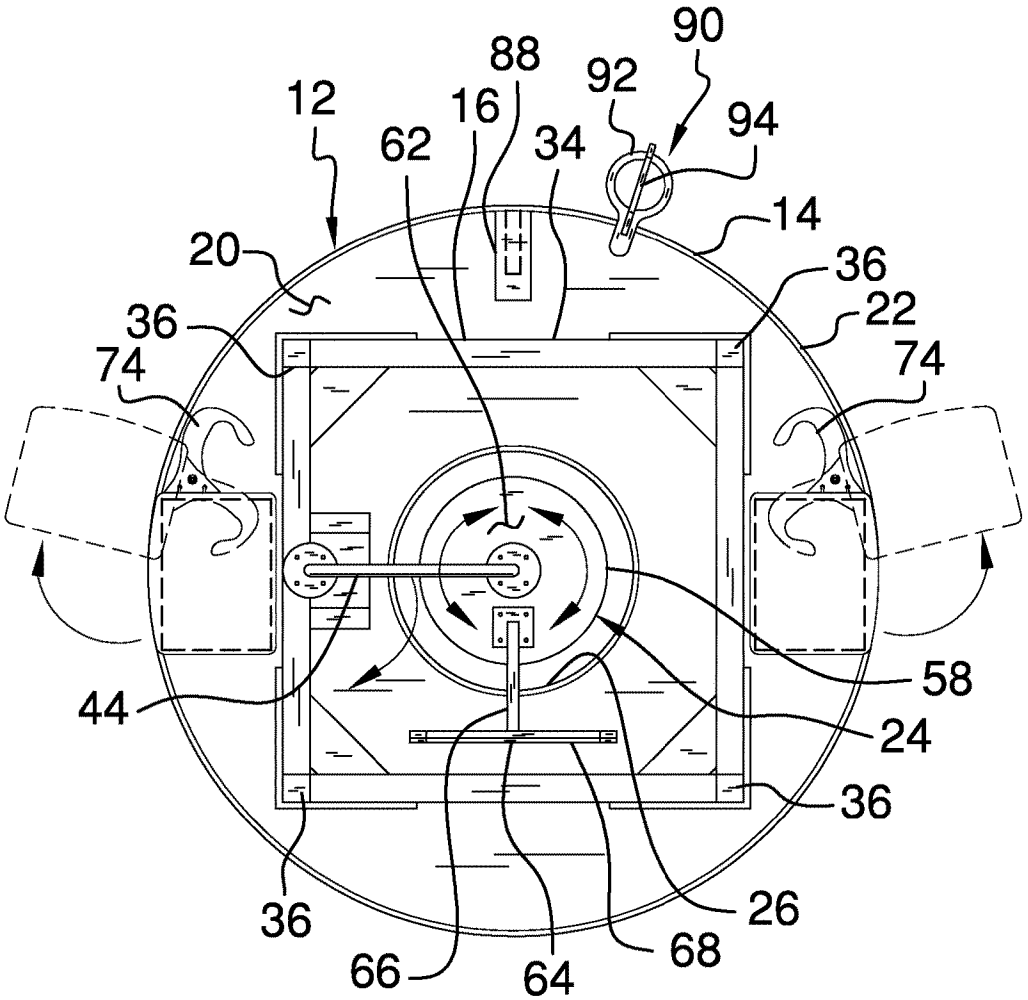
FIG. 4 is a bottom view of an embodiment of the disclosure.
Figure 5:
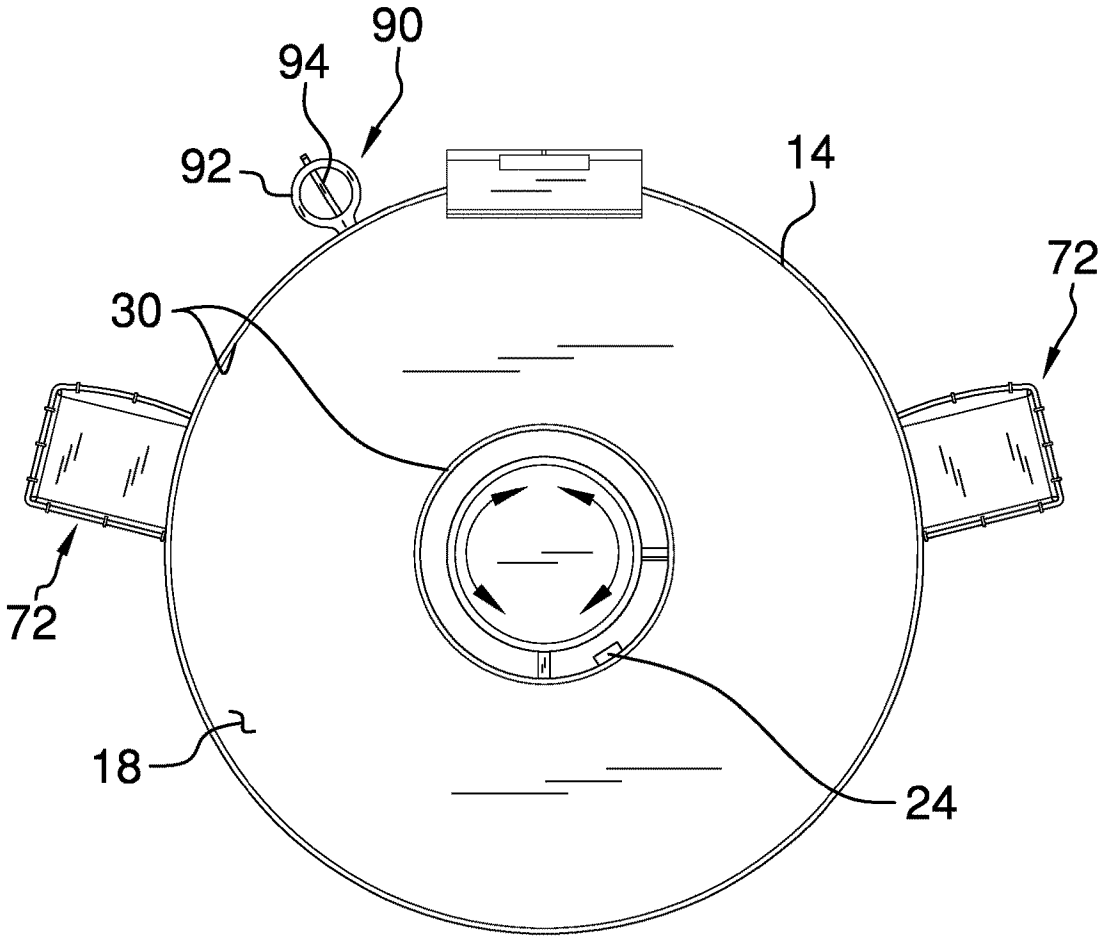
FIG. 5 is a top view of an embodiment of the disclosure.

With reference now to the drawings, and in particular to FIGS. 1 through 5 thereof, a new table device embodying the principles and concepts of an embodiment of the disclosure and generally designated by the reference numeral 10 will be described.

As best illustrated in FIGS. 1 through 5, the children's table assembly 10 generally comprises a table 12 that has a platform 14 and a frame 16. The platform 14 includes a top surface 18, a bottom surface 20 and a perimeter edge 22 extending between the top surface 18 and the bottom surface 20. The platform 14 has an opening 24 extending through the top surface 18 and the bottom surface 20. The opening 24 is centrally positioned on the platform 14 and the opening 24 has a bounding surface 26. The perimeter edge 22 is arcuate such that the platform 14 has a circular shape and the bounding surface 26 is concentric with the perimeter edge 22 such that the platform 14 has a donut shape. The top surface 18 may have a plurality of objects 28 placed thereon and the objects 28 may comprise children's toys or the like.

A pair of lips 30 is provided and each of the lips 30 is attached to and extends upwardly from the top surface 18 of the platform 14. Thus, each of the lips 30 prevents the objects 28 from falling off of the platform 14. One of the lips 30 is coextensive with the perimeter edge 22 and one of the lips 30 is coextensive with the bounding surface 26. The platform 14 may have a diameter ranging between approximate 30 inches and 40 inches and the opening 24 may have a diameter ranging between approximately 14 inches and 20 inches.

The frame 16 includes a support section 34 and a plurality of legs 36. The support section 34 is attached to the bottom surface 20 of the platform 14 such that the support section 34 surrounds the opening 24. Each of the legs 36 is attached to and extends downwardly from the support section 34. Thus, each of the legs 36 may support the platform 14 above a support surface 38. The support surface 38 may be a floor or the like.

A chair 40 is rotatably coupled to the table 12. The chair 40 is positioned on the frame 32 thereby facilitating a user 42 to access an entirety of the platform 14. The chair 40 includes a support 44 that has a first end 46 and a second end 48. The support 44 is elongated between the first end 46 and the second end 48 and the support 44 has pair of bends 50 thereon. The bends 50 are spaced apart from each other to define a first portion 52 and a second portion 54 each extending upwardly from a central portion 56. The first portion 52 and the second portion 54 may each form a right angle with respect to the central portion 56.

The first portion 52 may have a length ranging between approximately nine inches and twelve inches and the second portion 54 may have a length ranging between approximately five inches and eight inches. The central portion 56 may have a length ranging between twelve inches and fifteen inches. The first end 46 is rotatably attached to the bottom surface 20 of the platform 14. The first end 46 is centrally positioned between the perimeter edge 22 and the bounding surface 26. Thus, the second portion 54 is aligned with a radius of the opening 24.

The chair 40 further includes a seat 58 that has a top surface 60 and a bottom surface 62. The bottom surface 62 is rotatably attached to the second end 48 and the top surface 60 may support the user 42. The user 42 may be a child. The seat 58 is aligned with the opening 24 such that the seat 58 positions the user 42 within the opening 24. The seat 58 is rotatable about an axis extending though the second portion 54 thereby facilitating the user 42 to have 360 degrees of access to the platform 14. The first portion 52 of the support 44 may be rotated to position the seat 58 outwardly from the perimeter edge 22 of the platform 14.

A foot rest 64 is attached to the seat 58. The foot rest 64 has a first member 66 that is attached to and extends downwardly from the bottom surface 20 and the first member 66 angles outwardly from the seat 58. The foot rest 64 has a second member 68 that is oriented transverse to the first member 66. The second member 68 is spaced downwardly from the bottom surface 20 such that the second member 68 may support feet 70 of the user 42.

A pair of containers 72 is provided and each of the containers 72 is rotatably coupled to the table 12 such that each of the containers 72 is positionable between a deployed position and a stored position. Each of the containers 72 comprises a hinge 74 that is rotatably attached to the bottom surface 20 of the platform 14. The hinge 74 is positioned proximate the perimeter edge 22 of the platform 14.

A bag 76 is attached to the hinge 74 and the bag 76 may be used to store the objects 28. The bag 76 is spaced outwardly from the perimeter edge 22 when an associated one of the containers 72 is positioned in the deployed position. Thus, the objects 28 may be removed from the bag 76. The bag 76 is positioned beneath the bottom surface 20 when the associated container 72 is positioned in the stored position.

An easel 78 is attached to the table 12 and the easel 78 comprises a support 80 and a panel 81. The support 80 has a first end 82 and the first end 82 of the support 80 is attached to the bottom surface 20 of the platform 14. The support 80 extends upwardly along the perimeter edge 22 of the platform 14. The panel 81 is attached to the support 80 such that the panel 81 is spaced from the top surface 18 of the platform 14. The panel 81 has a top edge 84 and a light emitter 86 is attached to the top edge 84. A sleeve 88 may be attached to the bottom surface 20 of the platform 14. The sleeve 88 may be positioned adjacent to the perimeter edge 22 and the sleeve 88 may insertable receive the first end 82 of the support 80.

A cup holder 90 is provided and the cup holder 90 includes a ring 92 and a support 94. The cup holder 90 is attached to the bottom surface 20 of the platform 14 such that the ring 92 is spaced from the perimeter edge 22 of the platform 14. The support 94 is positioned beneath the ring 92. A cup or the like may be positioned within the ring 92 such that the cup is supported on the support 94.

In use, the user 72 sits on the chair 40. The objects 28 are positioned in the top surface 18 of the platform 14 and the user 42 spins in the chair 40 to access all areas of the platform 14. The easel 78 is used for art projects or the like. The objects 28 are stored within the pair of containers 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A children's table assembly having a rotatable chair, said assembly comprising:

a table having a platform and a frame;

a chair being rotatably coupled to said table, said chair being positioned on said frame wherein said chair is configured to facilitate a user to access an entirety of said platform;

a pair of containers, each of said containers being rotatably coupled to said table such that each of said containers is positionable between a deployed position and a stored position; and an easel being attached to said table;

wherein said platform includes a top surface, a bottom surface and a perimeter edge extending between said top surface and said bottom surface, said platform having an opening extending through said top surface and said bottom surface and defined by a bounding surface, said opening being centrally positioned on said platform;

wherein said chair includes a support having a first end and a second end, said support being elongated between said first end and said second end, said support having pair of bends thereon, each of said bends being spaced apart from each other to define a first portion and a second portion each extending upwardly from a central portion;

wherein said platform has a bottom surface; said first end is attached to said bottom surface of said platform, said first end being centrally positioned between said perimeter edge and said bounding surface, and having said second portion being aligned with a radius of said opening; and wherein said chair further includes a seat having a top surface and a bottom surface, said bottom surface being rotatably attached to said second end, said top surface being configured to support a user.

2. The assembly according to claim 1, wherein said perimeter edge is arcuate such that said platform has a circular shape, said bounding surface is concentric with said perimeter edge such that said platform has a donut shape, and said top surface is configured to have a plurality of objects placed thereon.

3. The assembly according to claim 2, further comprising a pair of lips, each of said lips being attached to an extending upwardly from said top surface of said platform wherein each of said lips is configured to prevent the objects from falling off of said platform, one of said lips being coextensive with said perimeter edge, one of said lips being coextensive with said bounding surface.

4. The assembly according to claim 2, wherein said frame includes a support section and a plurality of legs, said support section being attached to said bottom surface of said table such that said support section surrounds said opening, each of said legs being attached to and extending downwardly from said support section wherein each of said legs is configured to support said platform above a support surface.

5. The assembly according to claim 1, wherein:

wherein said seat is aligned with said opening wherein said seat is configured to position the user within said opening, said seat being rotatable about an axis extending though said second portion wherein said seat is configured to facilitate the user to have 360 degree access to said platform.

6. The assembly according to claim 5, wherein said chair further includes a foot rest being attached to said seat, said foot rest having a first member being attached to and extending downwardly from said bottom surface, said first member angling outwardly from said seat, said foot rest having a second member being oriented transverse to said first member, said second member being spaced downwardly from said bottom surface wherein said second member is configured to support feet of the user.

7. The assembly according to claim 1, wherein each of said containers comprises a hinge being rotatably attached to said bottom surface of said platform, said hinge being positioned proximate said perimeter edge of said platform.

8. The assembly according to claim 7, wherein each of said containers further comprising a bag being attached to said hinge, said bag being spaced outwardly from said perimeter edge when an associated one of said containers is positioned in said deployed position, said bag being positioned beneath said bottom surface when said associated container is positioned in said stored position.

9. The assembly according to claim 1, wherein said easel comprises a support and a panel, said support being attached to said bottom surface of said platform, said support extending upwardly along said perimeter edge of said platform, said panel being attached to said support such that said panel is spaced from said top surface of said platform.

10. A children's table assembly having a rotatable chair, said assembly comprising:

a table having a platform and a frame;

said platform including a top surface, a bottom surface and a perimeter edge extending between said top surface and said bottom surface, said platform having an opening extending through said top surface and said bottom surface, said opening being centrally positioned on said platform, said opening having a bounding surface, said perimeter edge being arcuate such that said platform has a circular shape, said bounding surface being concentric with said perimeter edge such that said platform has a donut shape, said top surface being configured to have a plurality of objects placed thereon, a pair of lips, each of said lips being attached to and extending upwardly from said top surface of said platform wherein each of said lips is configured to prevent the objects from falling off of said platform, one of said lips being coextensive with said perimeter edge, one of said lips being coextensive with said bounding surface, said frame including a support section and a plurality of legs, said support section being attached to said bottom surface of said table such that said support section surrounds said opening, each of said legs being attached to and extending downwardly from said support section wherein each of said legs is configured to support said platform above a support surface;

a chair being rotatably coupled to said table, said chair being positioned on said frame wherein said chair is configured to facilitate a user to access an entirety of said platform, said chair including:

a support having a first end and a second end, said support being elongated between said first end and said second end, said support having a pair of bends thereon, each of said bends being spaced apart from each other to define a first portion and a second portion each extending upwardly from a central portion, said first end being attached to said bottom surface of said platform, said first end being centrally positioned between said perimeter edge and said bounding surface and having said second portion being aligned with a radius of said opening, a seat having a top surface and a bottom surface, said bottom surface being rotatably attached to said second end, said top surface being configured to support a user, said seat being aligned with said opening wherein said seat is configured to position the user within said opening, said seat being rotatable about an axis extending though said second portion wherein said seat is configured to facilitate the user to have 360 degree access to said platform, and a foot rest being attached to said seat, said foot rest having a first member being attached to and extending downwardly from said bottom surface, said first member angling outwardly from said seat, said foot rest having a second member being oriented transverse to said first member, said second member being spaced downwardly from said bottom surface wherein said second member is configured to support feet of the user;

a pair of containers, each of said containers being rotatably coupled to said table such that each of said containers is positionable between a deployed position and a stored position, each of said containers comprising:

a hinge being rotatably attached to said bottom surface of said platform, said hinge being positioned proximate said perimeter edge of said platform, and a bag being attached to said hinge, said bag being spaced outwardly from said perimeter edge when an associated one of said containers is positioned in said deployed position, said bag being positioned beneath said bottom surface when said associated container is positioned in said stored position; and an easel being attached to said table, said easel comprising a support and a panel, said support being attached to said bottom surface of said platform, said support extending upwardly along said perimeter edge of said platform, said panel being attached to said support such that said panel is spaced from said top surface of said platform.

* * * * *